United States Patent [19]

Hattori

[11] Patent Number: 5,025,155

[45] Date of Patent: Jun. 18, 1991

[54] CHARGING DEVICE FOR ELECTROPHOTOGRAPHIC SYSTEMS

[75] Inventor: Yoshihiro Hattori, Osaka, Japan

[73] Assignee: Minolta Camera Kabushiki Kaisha, Osaka, Japan

[21] Appl. No.: 321,312

[22] Filed: Mar. 10, 1989

[30] Foreign Application Priority Data

Mar. 11, 1988 [JP] Japan ..... 63-58807

[51] Int. Cl.[5] ..... H01T 19/04

[52] U.S. Cl. ..... 250/326; 422/186.04; 422/907; 355/225; 250/324

[58] Field of Search ..... 422/907, 186.04; 250/324, 326; 355/3 R

[56] References Cited

U.S. PATENT DOCUMENTS

| | | | |
|---|---|---|---|
| 3,797,927 | 3/1974 | Takahashi et al. | 355/3 |
| 4,165,169 | 8/1979 | Miyashita et al. | 355/5 |
| 4,168,974 | 9/1979 | Ando et al. | 96/1 |
| 4,179,211 | 12/1979 | Kimura et al. | 355/14 |
| 4,320,956 | 3/1982 | Nishikawa et al. | 355/3 |
| 4,379,969 | 4/1983 | Cobb et al. | 250/324 |
| 4,476,387 | 10/1984 | Cobb et al. | 250/324 |

FOREIGN PATENT DOCUMENTS

| | | |
|---|---|---|
| 49-30454 | 8/1975 | Japan . |
| 59-107365 | 6/1984 | Japan . |

*Primary Examiner*—Stephen J. Lechert, Jr.
*Assistant Examiner*—Nina Bhat
*Attorney, Agent, or Firm*—Burns, Doane, Swecker & Mathis

[57] ABSTRACT

A corona charging device for charging a surface of a moving member, the device including a plurality of wire electrodes for generating corona discharge at a high voltage applied thereto, and a grid electrode located between the moving member and the wire electrodes, wherein a distance between the grid electrode and the moving member is shortest immediately below the wire electrode located most downstream in the moving direction of the moving member.

12 Claims, 8 Drawing Sheets

CHARGING DEVICE FOR ELECTROPHOTOGRAPHIC SYSTEMS

BACKGROUND OF THE INVENTION

The present invention relates generally to a charging device for charging a moving member as it travels pass the device. More particularly, the present invention relates to a corona charging device adapted for use in electrophotographic systems, wherein the corona charging device includes a plurality of corona discharge wires and a grid electrode, which is interposed between the wires and a photosensitive drum (hereinafter referred to as the PC drum).

It is known in the art to employ a plurality of discharge wires in electrophotographic systems so as to increase the efficiency of charging devices.

A typical example of the known charging devices is shown in FIG. 9, in which a plurality of discharge wires (in FIG. 9 they are represented by two wires a and b) are equally spaced from a PC drum, the wires being extended in parallel with each other. There is provided a grid electrode G between the discharge wires a, b and the PC drum, the grid electrode being made of stainless steel meshwork or lath. The grid electrode G is extended in parallel with a plane including the discharge wires a, b. FIG. 10 shows another example which is provided with a grid electrode $G_W$ extended in parallel with the PC drum. Each charging devices of FIGS. 9 and 10 are provided with a covering plate S above the discharge wires a, b.

The ultimate surface potential on the PC drum depends upon the porosity or degree of openness of the grid electrode, the grid voltage or the varistor voltage induced when the grid electrode is grounded through the varistor, and the distance between the grid electrode and the PC drum. Especially it is important what a distance the grid electrode and the PC drum are spaced from each other immediately below the discharge wires.

In FIG. 9 the distance d between the grid electrode and the PC drum immediately below the discharge wires a, b is larger than the distance $\alpha$ therebetween below a middle point between the two wires a and b. the $d > \alpha$ relationship results in the low ultimate surface potential. As a solution the grid electrode is placed closer to the PC drum. However, the closer placement of the grid electrode to the drum is likely to cause leaks therebetween.

The disadvantage of the device of FIG. 10 is the difficulty of extending a plurality of grid wires w at equal intervals and under equal tension, and maintaining an equal distance from the PC drum. The assembling of the device requires an experience and skill, which reflects in the production cost.

SUMMARY OF THE INVENTION

The present invention is directed toward overcoming the difficulties of the prior art charging devices discussed above.

Thus an object of the present invention is to provide a charging device capable of achieving an increased surface potential on a moving member such as a photosensitive drum at a relatively low voltage applied to discharge wires.

Another object of the present invention is to provide a charging device of such a simplified construction as to require no experience or skill to assemble.

According to one aspect of the present invention, there is provided a corona charging device for charging a moving member such as a photosensitive drum, the device comprising a plurality of wire electrodes extending in parallel with each other and axially with the moving member, a high voltage power source for applying high voltage to the wire electrodes so as to generate corona discharge, and a grid electrode interposed between the wire electrodes and the moving member, wherein a distance between the grid electrode and the moving member is shortest immediately below the discharge wire located most downstream in the moving direction of the moving member. Hereinafter the wire electrode located downstream in the moving direction of the moving member will be referred to as the downstream wire electrode.

According to another aspect of the present invention, there is provided a corona charging device for charging a moving member such as a photosensitive drum, the device comprising a plurality of wire electrodes extending in parallel with each other and axially with the moving member, a high voltage power source for applying a high voltage to the wire electrodes so as to generate corona discharge, and a grid electrode located between the moving member and the wire electrodes, wherein the grid electrode is disposed at a shorter distance from that portion of the moving member which is immediately below the last downstream wire electrode with respect to the moving direction of the moving member than from that portion of the moving member which is immediately below any wire located upstream of the last downstream wire.

Other objects and advantages of the present invention will become more apparent from the following detailed description, when taken in conjunction with the accompanying drawings which show, for the purpose of illustration only, specific embodiments in accordance with the present invention.

DETAILED DESCRIPTION OF THE PREFERRED EMBODIMENTS

Figure 1:
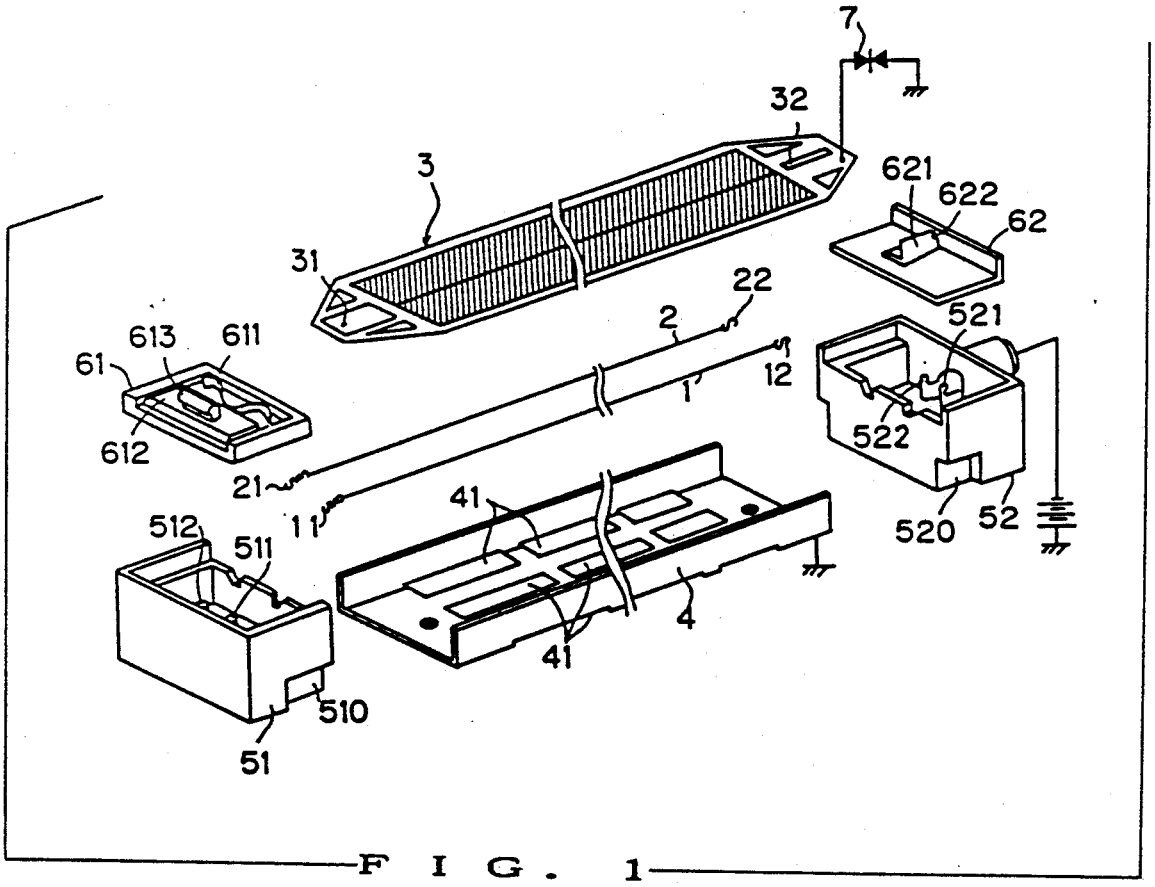
FIG. 1 is an exploded perspective view showing a corona charging device according to the present invention.
Figure 2:
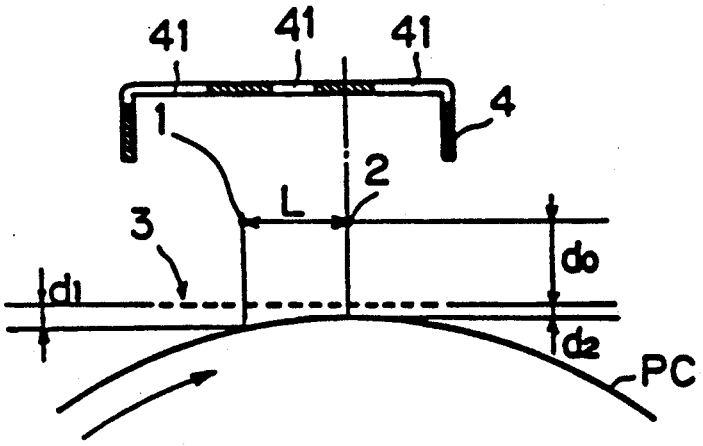
FIG. 2 is a diagrammatic view showing the device of FIG. 1 in simplified form.

Referring to FIGS. 1 and 2, which show an example (1) embodying the present invention, it will be seen that the corona charging device (hereinafter referred to as the charging device or merely device) includes a first corona discharge wire 1, a second corona discharge wire 2 and a grid electrode 3. The grid electrode 3 is interposed between the corona discharge wires 1, 2 and a photosensitive drum (hereinafter referred to the PC drum). The corona discharging wires 1 and 2, which will be hereinafter referred to as the corona wire or merely wire, are extended in parallel with each other. Facing the corona wires 1, 2 there is provided a covering plate 4 in opposite side to the grid electrode 3.

The corona wires 1, 2 are made of gold-plated tungsten (50 μm diameter). The grid electrode 3 has an open structure, such as meshwork or lath made of stainless steel. The covering plate 4 is provided with apertures 41 so as to allow ozone produced under the corona discharge to escape out of the discharge zone.

As best shown in FIG. 1, the device is provided with holders 51, 52 at each side, which secure the covering plate 4 by means of mortises 510, 520.

The holder 51 is provided with pins 511, 512 to which the corona wires 1, 2 are respectively fastened. The holder 52 is provided with connectors 521, 522 to which the corona wires 1, 2 are respectively connected. For engagement convenience the corona wires 1 and 2 have elastic coil portions 11 and 21 at their one ends, which are respectively engaged with the pins 511 and 512. The wires 1 and 2 also have hooks 12 and 22 at the other ends, which are respectively engaged with the connector 521 and 522. In this way the corona wires 1 and 2 are extended between the holders 51 and 52, wherein, a shown in FIG. 2, the wires 1, 2 are spaced from the PC drum and in parallel with the axis of rotation thereof.

The holders 51 and 52 support grid holders 61 and 62, respectively. The grid holder 61 is provided with a slider 612 slidable in the direction of the corona wires 1, 2, against a leaf spring 611. The grid holder 62 includes an engaging member 621 having a recess 622.

The grid electrode 3 is provided with apertures 31 and 32 at opposite ends. The aperture 31 is engaged with a projection 613 of the slider 612, and the aperture 32 is engaged with the recess 622 of the engaging member 621. In this way the grid electrode 3 is maintained between the corona wires 1, 2 and the PC drum. The grid electrode 3 is maintained in parallel with a plane including the corona wires 1, 2. It will be particularly noted from FIG. 2 that the distance between the grid electrode 3 and the PC drum is shortest immediately below the last downstream corona wire 2. The shortest distance is arranged not to be such as to cause leaks between the grid electrode 3 and the PC drum.

A voltage is applied to the corona wires 1, 2 through the connectors 521, 522 of the holder 52. The grid electrode 3 is grounded through the varistor 7. The covering plate 4 is also grounded.

The charging device is operated to charge the PC drum as follows:

6.3 KV voltage is applied to each of the corona wires 1 and 2. The distance L between the wires 1 and 2 is 10 mm. The distance $d_0$ between the wires 1, 2 and the grid electrode 3 is 8 mm. The distance $d_1$ between the PC drum and that portion of the grid electrode 3 which is immediately below the wire 1 is 1.63 mm. The distance $d_2$ between the PC drum and that portion of the grid electrode 3 which is immediately below the wire 2 is 1 mm (it is presumed that there can be no shorter distance than 1 mm). Now, suppose that the PC drum has a diameter of 80 mm and a length of 400 mm, and rotates at a circumferential velocity of 211 mm/sec (in the clockwise direction in FIG. 2). Herein the $d_1$ and $d_2$ are distances measured perpendicularly between the respective wires 1, 2 and a plane including the grid electrode 3.

Before the surface of the PC drum reaches the charge zone, any toner thereon is removed by a cleaner (not shown) and any charge remaining thereon is erased by an eraser lamp (not shown). The corona wires 1 and 2 generate ionic flows $I_C$ of about 700 μA. The varistor 7 passes an electric current $I_G$ between the ground and the grid electrode 3 at a potential difference $V_G$ of 850 V.

After the surface of the PC drum is substantially at zero potential, it is charged by the corona wire 1 thereby to have a surface potential $V_{O1}$. The wire 1 is further charged by the corona wire 2 thereby to have a surface potential $V_{O2}$. As described above, the device is disposed such that the grid electrode 3 is situated at a smallest distance from the PC drum immediately below the last downstream wire 2. As a result, the difference between the voltage $V_G$ of the varistor 7 and the ultimate surface potential $V_{O2}$ on the PC drum is minimized, and it is not required to locate the grid electrode 3 so close to the PC drum as to cause leaks therebetween. Thus the stable high charging zone is maintained.

Figure 9:
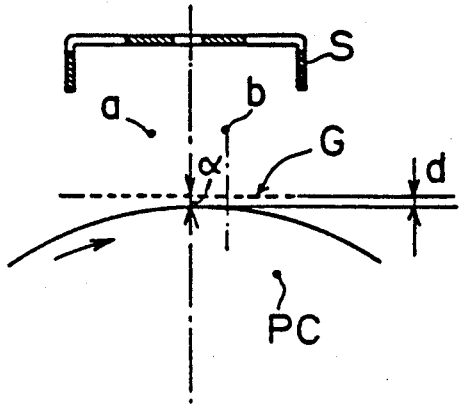
FIG. 9 is a diagrammatic view showing a prior art charging device in simplified form.

The advantages of the present invention will be more clearly appreciated from the comparison with the prior art of FIG. 9:

In FIG. 9, suppose that the minimum distance between a grid electrode G and a PC drum is 1 mm, wherein the distance is at a middle point between two corona wires a and b. Therefore, d=1.16 mm is obtained from a calculation, wherein d is the distance between the grid electrode G and the PC drum at a point immediately below the corona wire b. The other arrangement is the same as that of the above-mentioned example. The device is operated in the same manner as described above, that is, by applying the same voltages to the corona wires a and b, and to the grid electrode G and the varistor. The covering plate S is also grounded.

Regardless of the same operation the result is different in that the ultimate surface potential $V_{O2}$ on the PC drum is lower than that in the example (1). The reason is that the distance d between the grid electrode G and the PC drum below the wire b is 16% larger than the distance $d_2$ in the example (1).

Figure 3A:
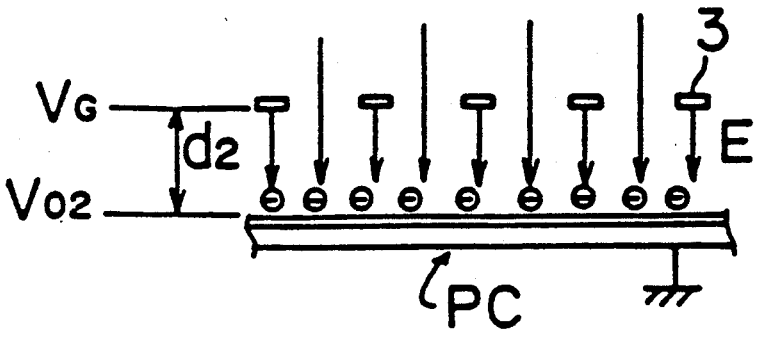
FIG. 3A is a diagrammatic view showing the state of charges on the photosensitive member by means of the device of FIG. 1.

More specifically, in the example (1) $V_G$ is 850 V, $d_2$ is 1 mm, and the ultimate surface potential $V_{O2}$ is 770 V, which means that the potential difference between the grid electrode 3 and the PC drum immediately below the corona wire 2 is 80 V (i.e. 850− 770). Analogously, if the PC drum is a flat plate, it can be approximated that when the grid electrode 3 and the PC plate are spaced at a distance of 1 mm, the electric field E therebetween will be $8\times10^4$ V/m (FIG. 3A).

Figure 3B:
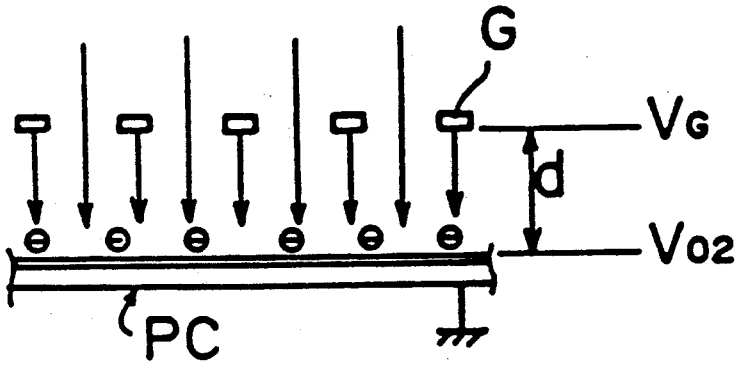
FIG. 3B is a diagrammatic view showing the state of charges on the photosensitive member by means of the prior art device of FIG. 9.

Likewise in FIG. 9, suppose that $8\times10^4$ V/m is set up for the electric field E between the grid electrode G and the PC drum immediately below the wire b, and hat the charge is imparted to the surface of the PC drum thereunder. The potential difference between the grid electrode G and the PC drum becomes about 93 V, which means that the potential difference is about 13 V lower than in the above-mentioned example (FIG. 3B). In FIGS. 3A and 3B, the arrows indicate the directions of electric field from (−) to (+), and the identical spacing between the arrows means that the electric fields have the same intensity. The charges stored on the surface of the PC drum decreases as the distance between the grid electrode and the PC drum becomes wider.

The experiments have revealed that the difference in the ultimate potentials between the example (1) and the prior art of FIG. 9 is much greater than the figure in calculation; actually, it was 740 V under the prior art. The reason will become apparent from FIG. 4. As suggested in FIG. 4, a plurality of corona wires generate a plurality of electric fields, which repel each other thereby to diffuse the ionic flows. As a result, the charge concentration occurs out of the shortest distance region between the grid electrode and the PC drum.

Figure 4:
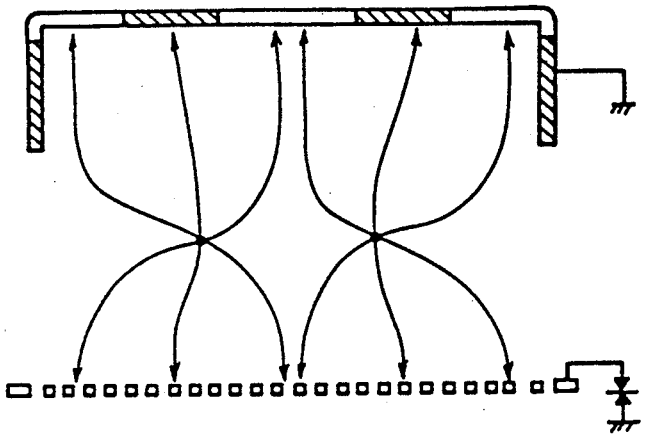
FIG. 4 is a diagrammatic view showing the lines of electric force occurring in the charging device in general.

FIG. 4 illustrates that the each corona wire generates six electric fields, wherein the arrows indicate the flowing directions of negative ions (i.e. opposite to the directions of the fields). It will be noted from FIG. 4 that the lines of electric force repel each other, and that the lines advancing toward the grid electrode and the covering plate become deviated outward before they reach them. The negatively-charged ions occurring near the wires tend to reach the PC drum along the shortest lines; that is, through the largest potential difference rather than along the curved roundabout lines. Small part of the charge reaches the PC drum from the center of the device through the grid electrode. This means that the shortest distance between the grid electrode and the PC drum is not effective if it is in the center of the grid electrode as shown in FIG. 9 because of the progressively diverging distance in the direction of rotation of the PC drum. This wastes the electric current $I_G$. It will be noted from FIG. 4 that most of ions gather and flow immediately below the corona wires in the device. The discovery of this fact teaches that the distance between the grid electrode and the PC drum should be controlled below the downstream corona wire so as to equalize the surface potential on the PC drum to the varistor voltage $V_G$. This secures a constant, efficient control of the charging.

In the example (1) the surface potential on the PC drum was raised by about 30 V as compared with the prior art device of FIG. 4.

Figure 3C:
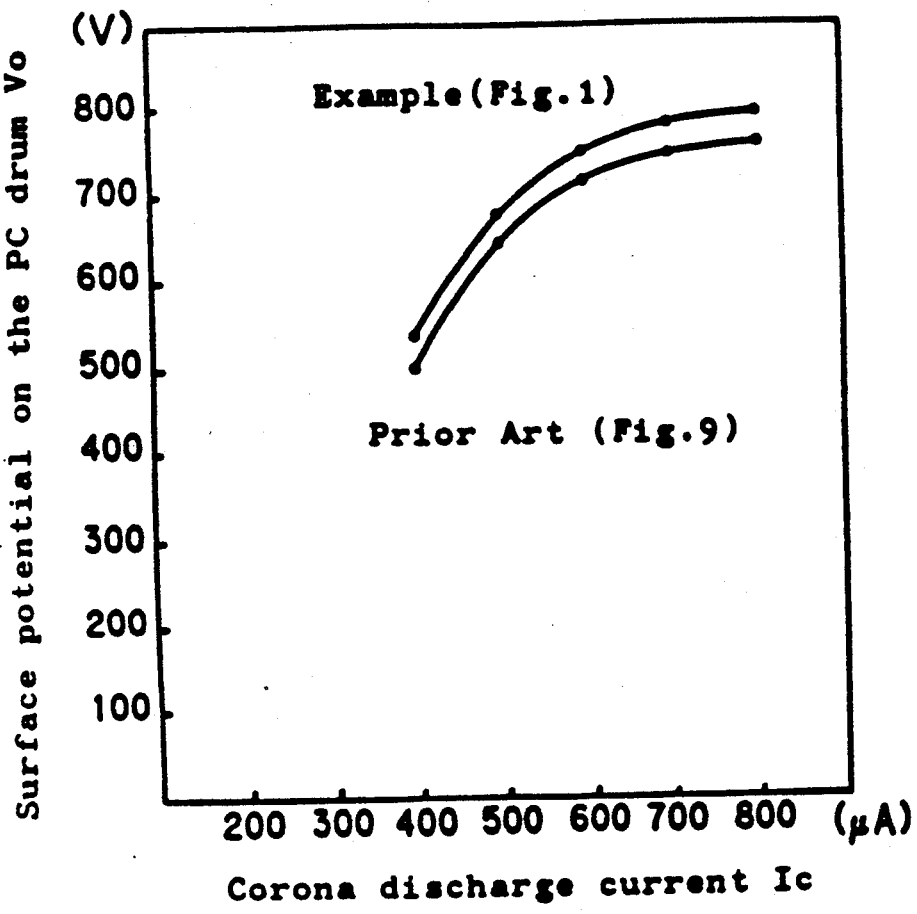
FIG. 3C is a graph showing the state of surface potentials on the photosensitive member for comparison between the device of FIG. 1 and the prior art device of FIG. 9.

FIG. 3C shows variations of the surface potential $V_O$ on the PC drum occurring in accordance with those of corona current $I_C$. When $I_C$ is not smaller than 700 μA, $V_O$ is virtually constant, which means that the Scorotron compensation is sufficient.

Figure 5:
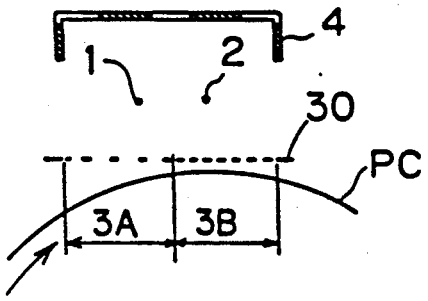
FIG. 5 is a diagrammatic view showing a modified version of the charging device according to the present invention.
Figure 6:
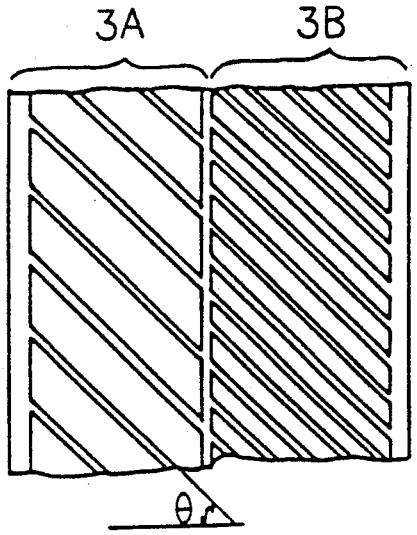
FIG. 6 is a plan view of a portion of the grid electrode.

Referring to FIGS. 5 and 6 an example (2) embodying the present invention will be described:

Basically the illustrated device has the same structure as that of the example (1), except for the grid electrode 30 being equally divided into two sections 3A and 3B. The section 3A is more porous than the section 3B. The porosity of the section 3A is 95%, whereas that of the section 3B is 90%, which means that the electrode density of the section 3A is lower than that of the section 3B. Each grid bar is inclined at $\theta$; in the illustrated embodiment $\theta$ is 45°.

As is evident from the foregoing description, the surface potential on the PC drum is more stably and certainly controlled by the downstream corona wire 2 than by the upstream corona wire 1. Accordingly, the charges on the PC drum by the upstream wire need not be so stable as by the downstream wire, thereby making it possible to impart a greater amount of charge to the PC drum by increasing the porosity or degree of openness of the upstream section 3A as compared with that of the downstream section 3B at the sacrifice of stability. In the example (2) of FIGS. 5 and 6 the amount of charge imparted by the upstream wire 1 is ½ of the total amount of charge, thereby minimizing the discharge current of each wire and lowering the entire corona discharge voltage. The corona discharge voltage is 6.3 KV in the example (1), and 6.1 KV in the example (2).

Figure 7:
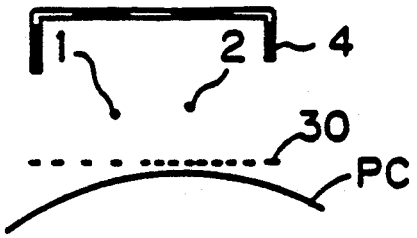
FIG. 7 is a diagrammatic view showing another modified version of the charging device according to the present invention.

Referring to FIG. 7, an example (3) embodying the present invention will be described:

This embodiment is different from the example (2) in that the upstream wire 1 is located closer to the grid electrode 30 than the downstream wire 2 is.

In general, when a charging device is provided with a plurality of corona wires, the discharge current ratios of wire to wire can be varied by changing the positional relationships between the corona wires and the covering plate, and the corona wires and the grid electrode, provided that the corona wires are connected to the same high-voltage power source.

When the corona wire is located as close to the grid electrode as in the example of FIG. 7, the discharge impedance is decreased, thereby facilitating the corona discharge. In the example (3) of FIG. 7 the discharge current ratio of the upstream corona wire 1 to the downstream wire 2 is about 6:4. As a result, the surface charge on the PC drum imparted by the wire 1 is about 70% of the total charge thereon. One of the resulting advantages is that the image is protected against a possible noise due to a stained corona wire. More specifically, even if the downstream corona wire is stained with toner or any other dirt, and is difficcult to emit corona, 70% of the charge is nevertheless imparted by the upstream corona wire, thereby minimizing noises. Even if the upstream corona wire is stained, the downstream corona wire will fairly compensate for the insufficient or inadequate charge if the downstream wire itself is safe from any stain. Usually a developing unit, which is notorious for its toner dispersion, is located on the copying machine at a downstream position. Accordingly, the increased amount of charge by the upstream wire results in the reduction of noises which otherwise would spoil the image on the PC drum.

The shape and size of the charging device used in the examples (1), (2) and (3) will be described:

The width of the opening of the grid electrode is preferably nearly equal to $d_2$ (See FIG. 2). If it exceeds $d_2$, it is likely that an excessive charge reaches the PC drum. If it is narrower than $d_2$, it is likely that a little charge is distributed over the PC drum, thereby resulting in an inadequate charge.

As the width of the opening ($d_2$) becomes narrower, $V_G$ (grid voltage or varistor voltage) − $V_O$ (the ultimate surface potential on the PC drum) becomes small. A narrow opening itself is desirable, but the degree of narrowness should be limited to such an extent as to prevent leaks from developing. The experiments show that the values $V_G$ and d preferably satisfy the following experimental formula:

$$\frac{V_G}{d} < 1 \times 10^6 \text{ (volts/meter)}$$

Where $V_G$ is the grid voltage or varistor voltage, and d is $d_2$. When $V_G$ is 850 V, it is derived from this relation that $d_2$ is preferably not smaller than 0.85 mm. If, after taking a possible error in design into consideration, $d_2$ is set to 1 mm±0.1 mm, safety will be secured with respect to the value of $V_G - V_O$ and the possibility of leaks.

The surface potential ($V_O$) on the PC drum depends upon the structure, the position and the potential of the grid electrode. However, if the distance ($d_0$) between the corona wire and the grid electrode (refer to FIG. 2) is too small, it becomes difficult to smooth the electric fileds in the neighborhood of the grid electrode, and leaks are likely to develop. Consequently, $d_0$ is preferably not smaller than 6 mm on the basis of the following relation:

$$\frac{V_G}{d} < 1 \times 10^6 \text{ (volts/meter)}$$

Figure 8:
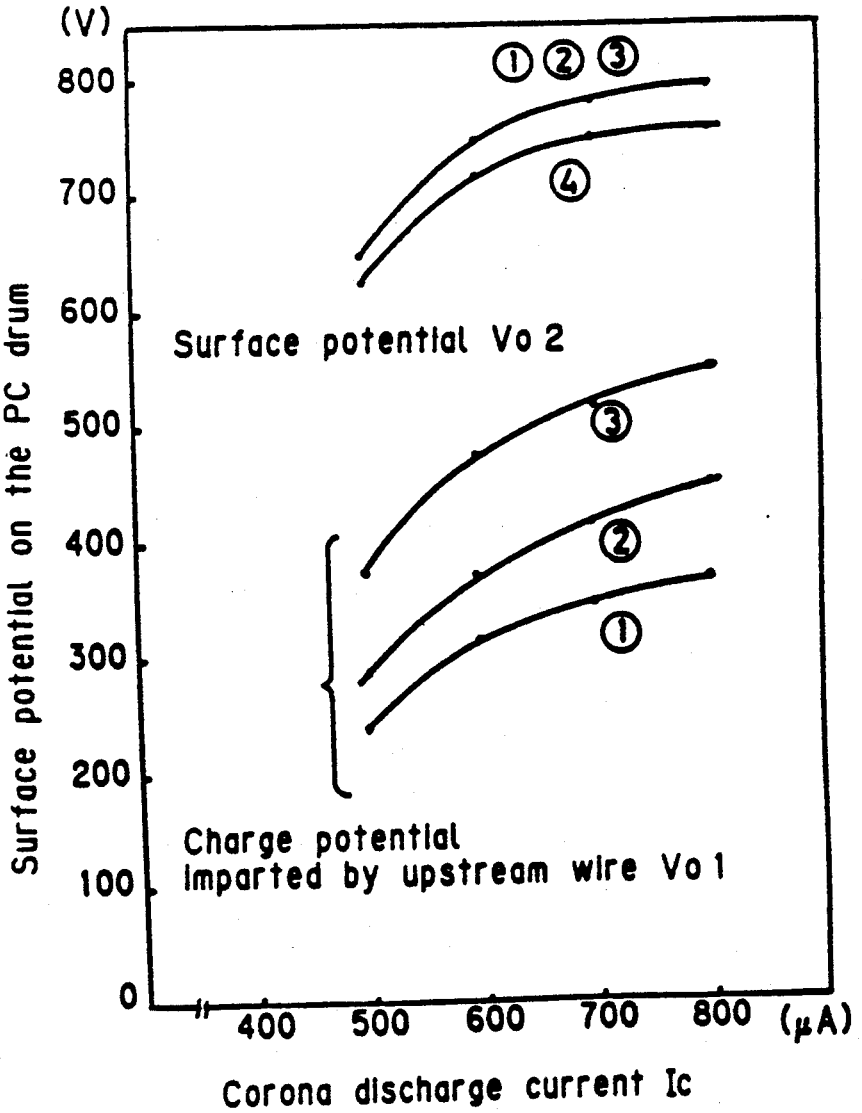
FIG. 8 is a graph showing the performances of charging the photosensitive member for comparison between the present invention and the prior art.

FIG. 8 shows graphs 1, 2, 3 and 4 representing variations in the charge potentials $V_{O1}$ on the PC drum effected by the upstream corona wire, and the ultimate surface potentials $V_{O2}$ thereon achieved by the examples (1), (2), (3) and the prior art of FIG. 9, respectively, in accordance with variations in the corona discharge current $I_C$. It will be appreciated from FIG. 8 that the examples embodying the present invention are more effective than the prior art to secure an ultimate surface potential on the PC drum. Each illustrated example uses two corona wires but they can be more than two.

Figure 10:
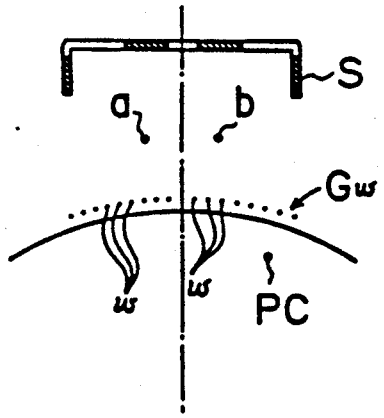
FIG. 10 is another example of a prior art charging device in simplified form.

As is evident from the foregoing description, a charging device according to the present invention can secure an increased surface potential as compared with the prior art device shown in FIG. 9 provided that the same voltage is applied to the corona wires. This means that the device of the present invention can secure a required surface potential at a relatively low voltage applied to the corona wires. Thus one of the advantages of the present invention is that the surface of the PC drum can be charged with constant stability and efficiency. Another advantage is that the structure can be simplified, which will become more apparent when it is compared with the prior art charging device shown in FIG. 10.

A further advantage is that the charging device of the invention speeds up the operation of a high-speed electrophotographic system because of its efficient and stable performance. A still further advantage is that the grid electrode and the PC drum can be maintained at a safe distance from leaks, without decreasing the charging efficiency.

In addition, a high output voltage is not required to energize the corona wires, thereby saving the costs. The production of ozone due to the discharge can be minimized, thereby eliminating the necessity of using an ozone filter, an ozone sucking apparatus and the like. This also saves the costs.

While the present invention has been illustrated and described as embodied for charging the photosensitive drum, it is not intended to be limited to the details and application shown, since various modifications, structural changes and adaptation may be made without departing from the spirit of the present invention.

What is claimed is:

1. A corona charging device for charging a surface of a moving member, the device comprising:

a plurality of wire electrodes extending in parallel with each other and axially with the moving member;

a high voltage power source for applying a high voltage to the wire electrodes so as to generate corona discharge; and a grid electrode located between the moving member and the wire electrodes, wherein a distance between the grid electrode and the moving member is shortest immediately below the last downstream wire electrode with respect to the moving direction of the moving member.

2. A corona charging device as claimed in claim 1, wherien the grid electrode is a meshwork.

3. A corona charging device as claimed in claim 2, wherein the grid electrode comprises a first section located upstream and a second section located downstream of the moving member, the first section having finer openings than the second section has.

4. A corona charging device as claimed in claim 1, wherein an upstream wire electrode is situated closer to the grid electrode than a downstream wire electrode is.

5. A corona charging device as claimed in claim 1, wherein the relationship between grid voltage $V_G$ and the distance d between the grid electrode and the moving member immediately below the wire electrode located most downstream in the moving direction of the moving member satisfies the following relation:

$$\frac{V_G}{d} < 1 \times 10^6 \text{ (volts/meter)}$$

6. A corona charging device for charging a surface of a moving member, the device comprising:

a plurality of wire electrodes extending in parallel with each other and axially with the moving member;

a high voltage power source for applying a high voltage to the wire electrodes so as to generate corona discharge; and a grid electrode located between the moving member and the wire electrodes, wherein the grid electrode is disposed at a shorter distance from that portion of the moving member which is immediately below a downstream wire electrode with respect to the moving direction of the moving member than from that portion of the moving member which is immediately below any wire located upstream of the downstream wire.

7. A corona charging device as claimed in claim 6, wherein the grid electrode is a meshwork.

8. A corona charging device as claimed in claim 7, wherein the grid electrode comprises a first section located upstream and a second section located downstream of the moving member, the first section having finer openings than the second section has.

9. A corona charging device as claimed in claim 6, wherein the upstream wire electrode is situated closer to the grid electrode than the downstream wire electrode is.

10. A corona charging device as claimed in claim 6, wherein the relationship between a grid electrode voltage $V_G$ and the distance d between the grid electrode and that portion of the moving member which is immediately below the last downstream wire electrode satisfies the following relation:

$$\frac{V_G}{d} < 1 \times 10^6 \text{ (volts/meter)}$$

11. A corona charging device for charging a surface of a moving member, the device comprising:

a pair of wire electrodes extending in parallel with each other and axially with the moving member;

a high voltage power source for applying a high voltage to the wire electrodes so as to generate corona discharge; and a grid electrode located between the moving member and the wire electrodes, wherein a distance between the grid electrode and the moving member is shortest immediately below the downstream wire electrode with respect to the moving direction of the moving member.

12. A corona charging device for charging a surface of a moving member, the device comprising:

a pair of wire electrodes extending in parallel with each other and axially with the moving member;

a high voltage power source for applying a high voltage to the wire electrodes so as to generate corona discharge; and a grid electrode located between the moving member and the wire electrodes, wherein the grid electrode is disposed at a shorter distance from that portion of the moving member which is immediately below a downstream wire electrode with respect to the moving direction of the moving member than from that portion of the moving member which is immediately below the other wire located upstream.

* * * * *